United States Patent [19]

Sanko

[11] 4,437,246

[45] Mar. 20, 1984

[54] PRESSING AND CREASING APPARATUS

[75] Inventor: John R. Sanko, Altoona, Pa.

[73] Assignee: Paris Manufacturing Company, Inc., Brockway, Pa.

[21] Appl. No.: 309,242

[22] Filed: Oct. 7, 1981

[51] Int. Cl.[3] ..... D06F 71/40; D06C 5/00

[52] U.S. Cl. ..... 38/25; 223/73

[58] Field of Search ..... 223/73, 74, 70, 76; 38/25, 27, 28, 30, 31, 32, 33, 34, 35, 42, 43, 12

[56] References Cited

U.S. PATENT DOCUMENTS

| | | | |
|---|---|---|---|
| 2,944,710 | 7/1960 | Bader | 223/70 |
| 3,272,408 | 9/1966 | Carpenter et al. | 223/73 |
| 3,365,107 | 1/1968 | Carpenter et al. | 223/73 |
| 3,439,845 | 4/1969 | Lester, Jr. | 223/73 |
| 3,713,567 | 1/1973 | Paris | 223/73 |
| 3,883,051 | 5/1975 | Bailey | 223/73 |

*Primary Examiner*—Werner H. Schroeder
*Assistant Examiner*—Andrew M. Falik
*Attorney, Agent, or Firm*—Parmelee, Miller, Welsh & Kratz

[57] ABSTRACT

A finishing apparatus for a pants-like garment is provided with a longitudinally extending support for a garment, a longitudinally extending, inflatable bag for supplying steam and air to the inside of the garment, and creasing blades that extend along the bag and engage the inside of the garment, such as each pants leg, to fold over the material and provide preliminary creases therealong. A pair of creasing heads also extend along the machine outside of the garment carried thereby and are provided with heating apparatus therefor. Each head has a pair of clamping blades swingably mounted to, after the inside creasing blades have been moved out of engagement with the folded-over length portions of the garment, cooperate with associated heads and engage the outside of the preliminary folded-over portions to provide final creases along the garment or the pants legs thereof. External and internal cooperating crotch-pressing heads are also provided for cooperative movement into and out of a pressing relation with the garment. The heads are moved into and out of a cooperating position with the outside of the garment in the use of the machine to fold-over length portions of and thereafter form creases therealong.

11 Claims, 15 Drawing Figures

PRESSING AND CREASING APPARATUS

BRIEF SUMMARY OF THE INVENTION

This invention relates to an improved finishing or pressing apparatus for garments in the nature of trousers, pants, slacks, shorts, etc. that have leg portions that are to be provided with creases and particularly, to apparatus having new and improved means for finishing a garment and for better-formed creases therealong.

DESCRIPTION OF THE PRIOR ART

The machine of the present invention is of a type such as generally disclosed in Bailey U.S. Pat. Nos. 3,934,766, 3,883,051 and 3,866,808. These patents show machines in which a garment is finished by applying hot air and steam to inside portions thereof through a permeable bag, and employ opposed pairs of expandable and contractable creasing blades carried by a longitudinally extending side arm. An outer crotch pressing head is also shown.

As distinguished from these patents, the present invention deals primarily with means for folding length portions of the garment and for then better finish-forming seams or creases therealong. It also provides an improved crotch pressing operation in which a pair of opposed fly-pressing heads are employed. Its capability of fully automatic step-by-step operation enables an operator to greatly increase garment finishing production and, if desired, to operate a couple of machines simultaneously.

DESCRIPTION OF THE INVENTION

Figures 1, 1A, 2, 6A:
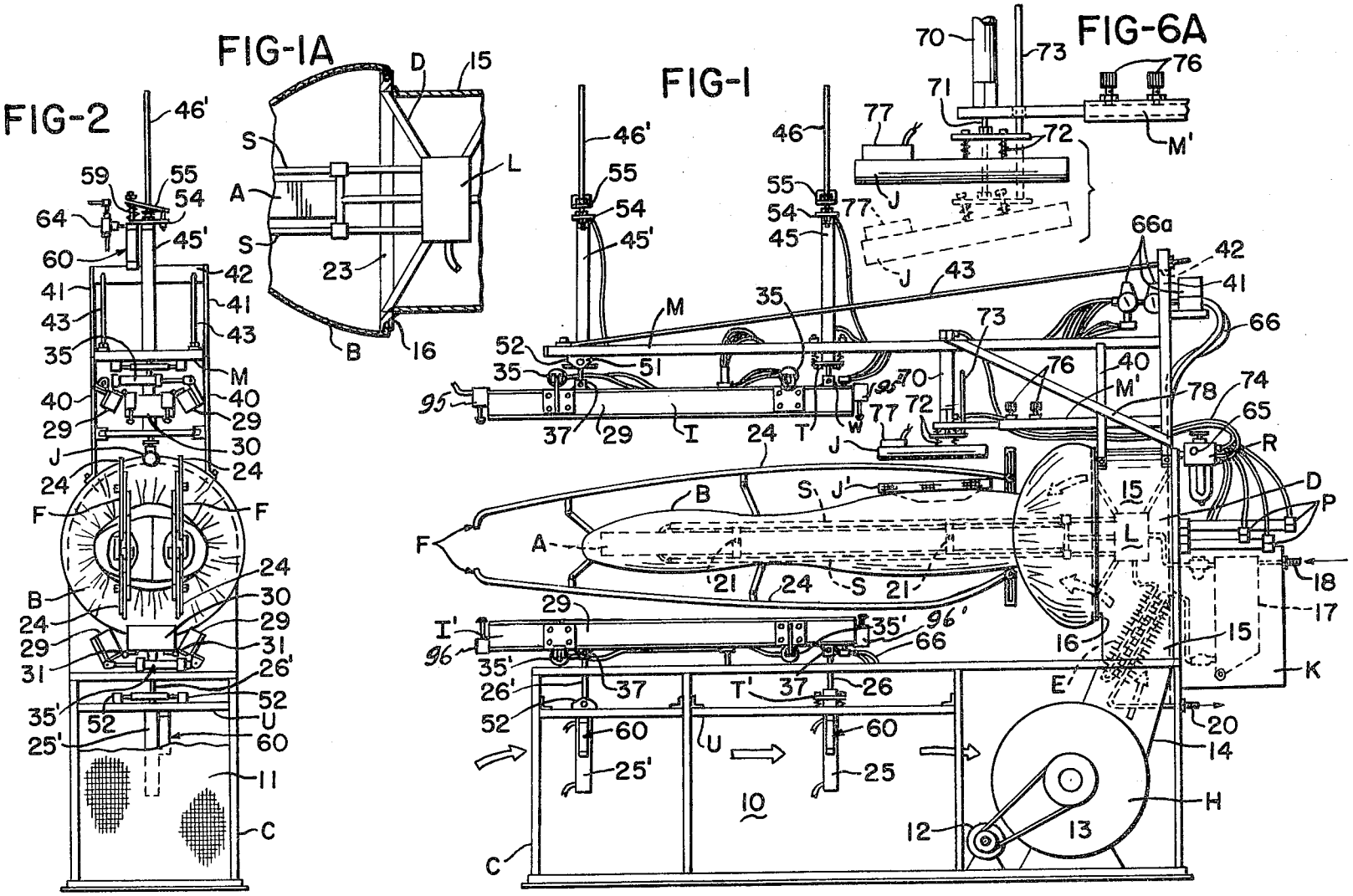
FIG. 1 is a side view in elevation of an apparatus constructed in accordance with the invention showing a permeable bag in a non-inflated ready position, creasing blade pairs for each garment leg in a contracted or partially collapsed garment-receiving position therealong, and with a pair of creasing-clamping heads in "out" positions with respect to the creasing blade pairs.
FIG. 1A is a fragmental side sectional view through a back end portion of the machine showing how the permeable bag may be mounted to extend from a header.
FIG. 2 is a front end view in elevation of the apparatus of and on the scale of FIG. 1. In this view, the lower creasing-clamping head, as in FIG. 1, is shown in a partially advanced position in order to clear a base extension portion of the support base of the apparatus; normally it is timed to move upwardly or towards a garment being finished at a slower rate than the downward movement of the upper head, such that both attain their cooperating inward creasing positions at the same time.
FIG. 6A is an enlarged side detail showing the construction and mounting of an opposed lower or inside-positioned fly or crotch pressing head.
Figures 3, 4, 4A, 5, 6:
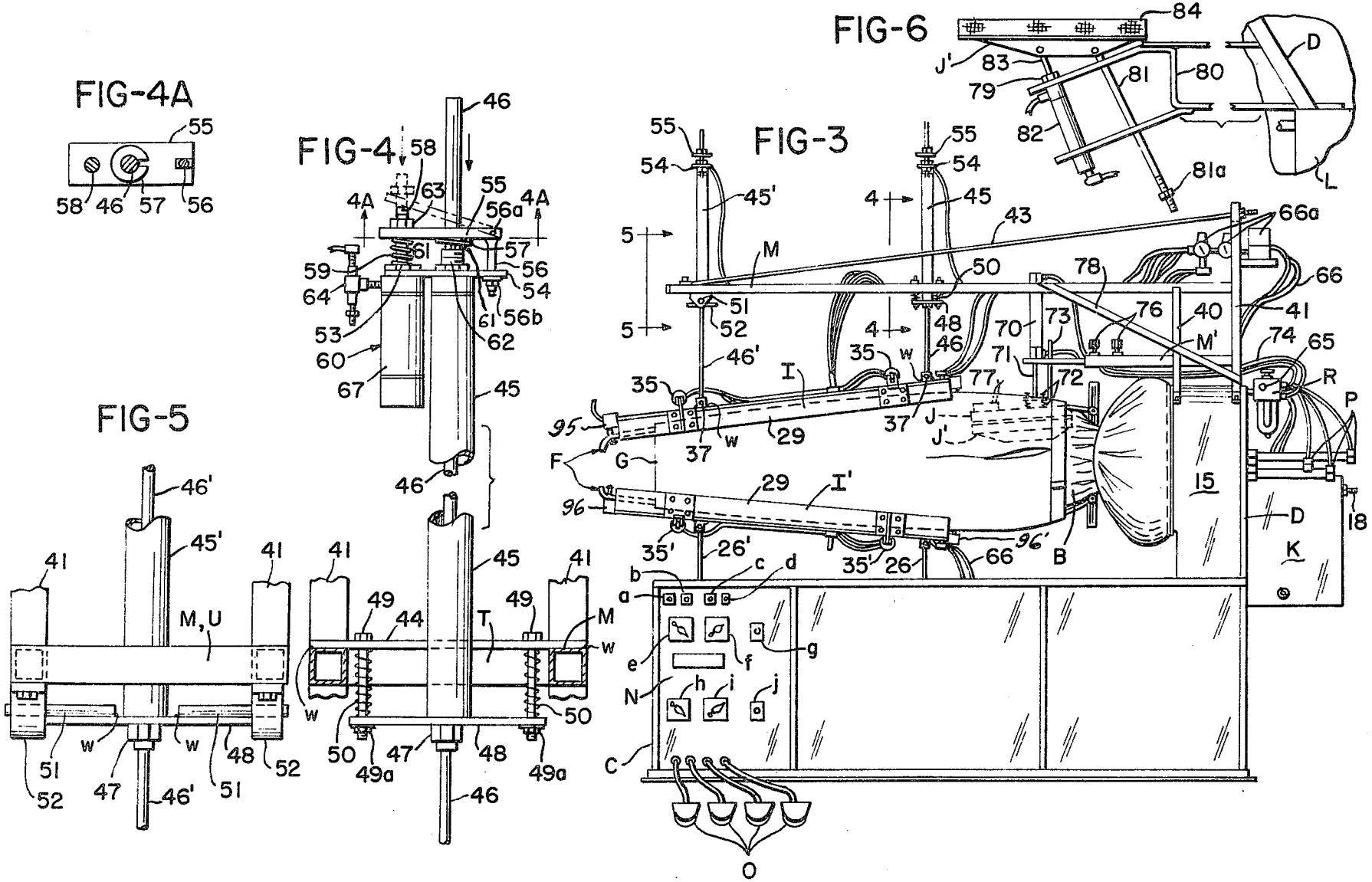
FIG. 3 is a side view in elevation on the scale of and of the apparatus of FIG. 1, the permeable bag in shown inflated within and along the garment to be finished, the creasing blade pairs are in an expanded supporting position along the inside of the legs of the garment being finished, and the pair of creasing-clamping heads are in cooperating, initial, crease-fold forming positions with and along associated creasing blade pairs.
FIG. 4 is an enlarged, broken-away end section in elevation showing the construction and mounting of vertically extending fluid motor and locking cylinder means that is positioned adjacent opposite ends of each of the creasing heads for moving them into a shape-conforming relation with the garment, as shown in FIG. 3; this figure also shows the flexible spring mounting which is employed for the back-end mounted motor and locking cylinder means of the upper and lower creasing heads.
FIG. 4A is a horizontal section taken along the line 4A—4A of FIG. 4 showing a detail of the mounting and construction of split-ring, spring-locking washer means.
FIG. 5 is a representative end fragment in elevation taken on line 5—5 of FIG. 3 and on the same scale as FIG. 4, showing the mounting of upper and lower, vertically extending fluid motors on front end portions of the opposed pair of creasing heads of FIG. 3; a locking cylinder and an upper portion of the motor cylinder are omitted in this figure, since they are the same as depicted in FIG. 4 with reference to the back end pairs of fluid motor and locking cylinder means.
FIG. 6 is an enlarged side detail showing the construction and mounting of an upper or outside-positioned fly or crotch pressing head.
Figure 7:
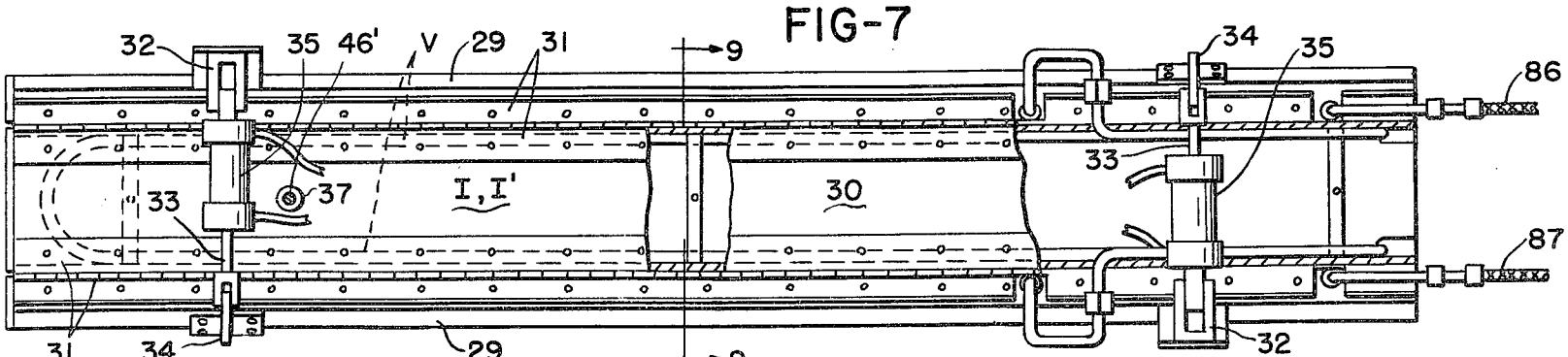
FIG. 7 is a horizontal or plan view taken along the outside of a representative creasing head, with portions broken away to show details of hidden steam heating system and spacer means; this figure is on an enlarged scale of FIGS. 4 to 6, inclusive.
Figure 8:
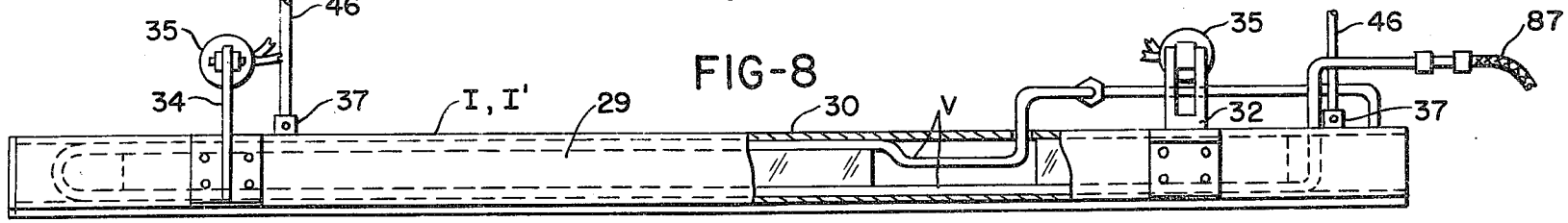
FIG. 8 is a side elevation on the scale and of the creasing head of FIG. 7, with portions broken-away to particularly illustrate details of the construction and of the closed, steam-heating pipe or tubular system that, as indicated, extends in a looped relation therealong, see also FIG. 10.
Figure 10:
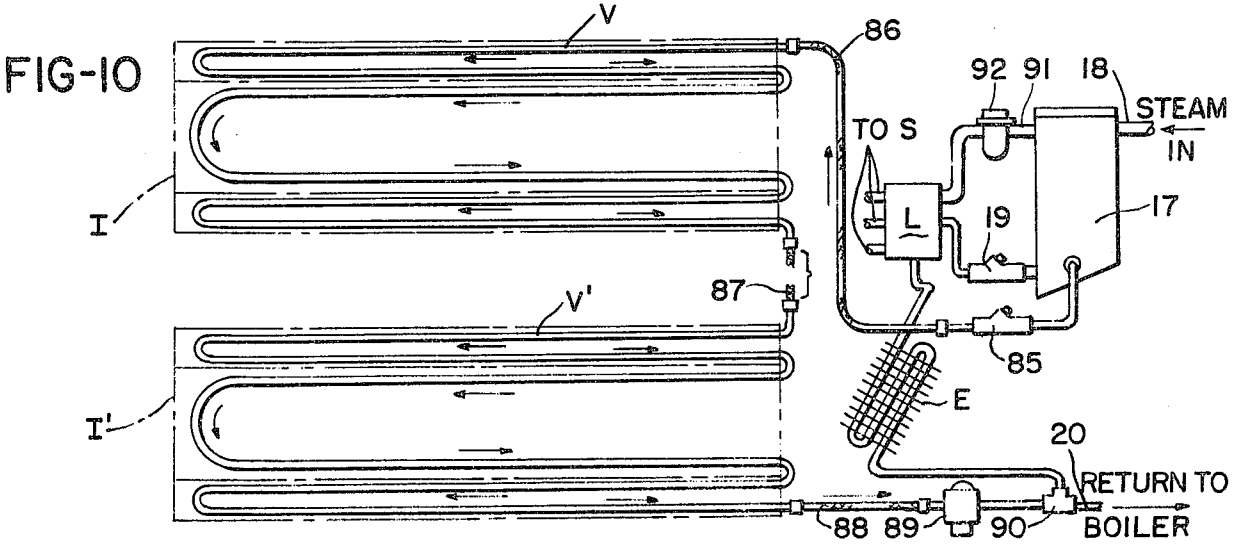
FIG. 10 is a reduced, somewhat diagrammatic view showing the steam heating system for the pair of upper and lower creasing heads, for the inside of the bag and for air supplied to the bag.
Figure 11:
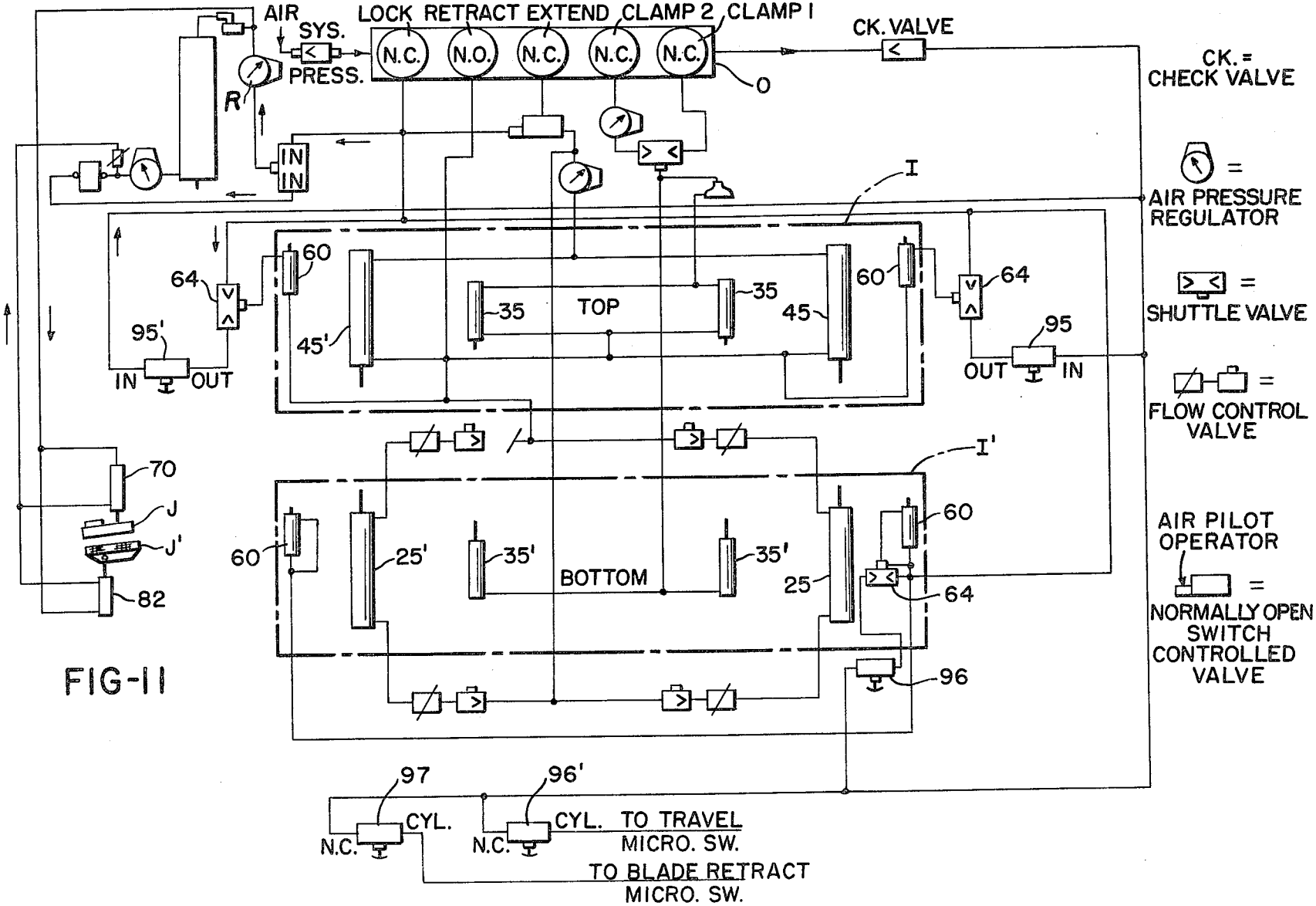
FIG. 11 is a schematic diagram showing operative connections for pneumatically effecting a manual or an automatic step-by-step operation of the machine through the use of fluid motor means, contact-finger-operated micro valve units, check valves, etc.

With particular reference to FIGS. 1 and 3, a garment finishing machine or apparatus is disclosed of a unitary type which, in accordance with the diagrams of FIGS. 10 and 11, may be operated fully automatically in a step-by-step, timed manner, may be manually interrupted in such operation to, for example, correct an improper positioning of the garment, and may be manually then restarted to automatically finish the operation. However, if desired, the entire step-by-step procedure may be manually controlled by the operator. See control panel or board N of FIG. 3 and pedal controls O of FIGS. 3 and 11 of the drawings.

The procedure involves positioning a permeable garment bag B along a longitudinally extending support arm A (see FIGS. 1 and 1A), with its selvage open back or mouth portion mounted in a groove flange or ring 16 that is carried by an upright, back end-positioned, head or support frame D (FIG. 3). The head D has a housing 15 that defines a hot air receiving chamber that is connected by ductwork 14 to a blower H in a main support frame or base C (see FIG. 1). A garment G to be finished (see FIGS. 2 and 3) is positioned along the support arm A with its legs extending along the outside of corresponding leg portions of a permeable bag B. The bag B is carried on blade pairs of an expandable-contractable or collapsible creasing blade assembly F that, at this time, may be in an initial collapsed position of FIG. 1. Thereafter, upper and lower pairs of creasing blades 24 of the assembly F are actuated by fluid or air motors P to expand them and the garment into a finishing-position along the permeable bag B. At this time, heated air provided by a blower H connected to and a heat exchanger E positioned within the connecting duct 14, may be introduced from the housing 15 into the open back end or mouth of the garment bag B. Simultaneously or independently of the air introduction, steam bursts may be introduced into the bag B from a steam manifold or header L to a vented tubular system S that is carried along the arm A. As shown in FIG. 1, cross-connecting clamps 21 mount upper and lower halves of the direct steam supply system S on the support arm A.

In the next step, a pair of upper and lower or opposed creasing heads I and I' may be moved inwardly towards each other and into engagement with the garment G that is positioned on now-expanded creasing blades 24 of the blade assembly F. Each creasing head has an associated pair of swingably-mounted, side-positioned clamping blades 29 (see also FIG. 9). The blades 29 are swingably secured by hinges 31 along opposite sides of a longitudinally extending central base member 30 (see also FIG. 2) to, in their open positions, define cooperating creasing blade and garment fold receiving V-slots or grooves therealong. When each head I and I' is moved into engagement with the garment G, it will cooperate with a pair of creasing blades 24 to pressure-form a pair of spaced-apart folds along one side of each leg of the garment.

Figure 9:
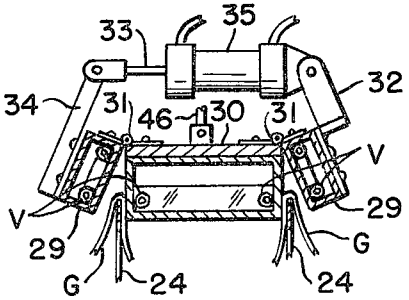
FIG. 9 is an end section on the scale of and taken along the line 9—9 of FIG. 7; this view not only illustrates a representative cross-extending fluid motor means for a pair of swingable, side-mounted clamping blades of each creasing head, but also further shows positioning of stream-heat piping.

As shown in FIG. 9, as associated creasing blade 24 of the assembly F will enter the groove or V-shaped slot defined by each clamping blade 29 that is to receive a garment leg fold of the garment therein. An application of closing force is then effected on the clamping blades 29 by transversely positioned pairs of fluid motors 35, 35' to thus initially form a pair of creases along each pants leg. Thereafter, upper and lower pairs of creasing blades 24 of the assembly F are withdrawn and collapsed, leaving garment crease folds in place between each clamping blade 29 and its associated central base member 30 of each creasing head I, I'. Each pair of clamping blades 29 of the upper and lower heads H is then subsantially fully closed with respect to their associated central member 30. At this time, clamping pressure on the clamping blades 29 is increased to provide a pair of final knife-like creases along opposite sides of the length of each leg of the garment G.

Before creasing blade assembly F is contracted or collapsed, an outer fly-pressing head J may be moved (see FIGS. 1 and 3) into garment pressing engagement with an inner head J' (see also FIG. 6), while the garment is being supported by the creasing blades 24 of the assembly F in their expanded positioning.

After a suitable dwell period in which creasing pressure is maintained between the side-positioned blades 29 and the central base member 30 of the heads I and I', the motors 35 35' are then actuated in a reverse direction to open the blades and release the creased portions of the legs of the garment G being finished. This is followed by a reverse operation of fluid motors 25, 25', 45 and 45' to lower the creasing head I' and raise the creasing head I with respect to each other to a starting positioning such as shown in FIG. 1. Steam heat is applied through closed, tubular circulating systems V and V' to maintain the heads I and I' at a suitable operating temperature, in the neighborhood of about 280° to 290° F. An electrical heating unit 77 is shown for maintaining the outer fly or crotch pressing head J at about the same temperature. After fly-pressing heads J and J' are also returned to their initial or starting positions by fluid motors 70 and 82 (see FIGS. 1 and 6), the then finished garment G may be removed from the collapsed creasing blade assembly F and another garment placed thereon for processing.

If desired, the creasing blade pneumatic or air operated motors 35' for the lower head I' may be single-acting. In such event, a spiral tension spring will be provided inside each motor housing in the engagement with the forward end of its piston to return it to a starting position when positive, forwardly moving blade closing pressure is released. In the creasing operation, a suitable initial holding pressure of about 40 pounds may be applied to the clamping blades 29 by the motors 35, 35'. After removal of the creasing blades 24 from positions between the clamping blades 29 and the central base members 30 by collapsing the creasing blade assembly F, the closing pressure on the clamping blades 29 may then be increased to about 80 pounds to effect the final crease forming operation. The creasing pressing operation may involve about 12 seconds of time; a timer (see FIG. 12) may be used in the circuit which enables adjustment of between 1 to 30 seconds, depending on the type of fabric. A normal period is about 10 to 12 seconds.

Referring particularly to FIGS. 1, 1A and 2 of the drawings, ambient air may be introduced through an open end screen 11 into an enclosed air supply chamber 10 that is defined by enclosing plate members for the base frame C. Air entering the chamber 10, as indicated by the arrows of FIG. 1, is introduced into the blower H which is driven by an electric motor 12 and belt 13. In this way, air is forced under pressure into the back-positioned housing 15. Air passing from the blower H through duct 14 is heated by the heat exchanger E which is supplied with residual steam returning through the steam manifold or header L (see also FIG. 10) from the vented tubular system S that is carried along the horizontal support arm A.

The system S is vented for supplying steam continuously or usually in bursts through the permeable bag B of nylon or other suitable material. In this connection the construction is similar to that shown in the Bailey U.S. Pat. No. 3,866,808. The supply of steam may be accomplished along with the introduction of hot air from the housing 15 through the open back end selvage edge portion of the bag B.

With reference to FIGS. 1 and 10, live steam is taken from a boiler or other suitable source through inlet 18 into a steam condensate separator and trap unit K. Steam leaves the upper chamber of the unit 17 through a steam supply line 91 and a valve 92 to enter the steam manifold L. Steam also leaves a bottom portion of the unit 17 through check valve 19 to enter the manifold L. Four lines are shown connected to extend from the manifold L, three of which supply live steam to the system S and a fourth of which is a return line that is connected to the heat exchanger E and T-connector 90 to return through the outlet 20 to a suitable source of steam (see also FIG. 1). A third line 86 leads from the separator unit 17 through a check valve 85 and is of flexible construction, such as of nylon and braided metal.

From the valve 85, the line 86 is connected to an inlet coupling of a closed tubular, metal loop, indirect steam heating system V for the upper head I (see FIG. 10). From the upper system V, steam passes throuh flexible metal tubing 87 to a second closed, tubular, indirect steam heating system V' for the lower head I', and from this head through flexible tubing 88 to steam trap 89, and connector 90 to return outlet 20. The indirect steam heating systems V and V' may be of a copper or other suitable heat conductive metal tubing and are preferably maintained in a heated condition at all times that the machine is being operated to provide the two creasing heads I and I' with suitable crease-forming temperatures.

Air under pressure for operating fluid motors, etc. is introduced into the machine through inlet fitting 65 (see FIGS. 1 and 3) of a filter, regulator and lubrication unit R which serves as a pneumatic or air supply manifold. Compressed air from the manifold R is passed, as shown, through separate lines 74 to four motors of a fluid motor assembly P to operate the creasing blades system F in the manner illustrated in the Bailey U.S. Pat. No. 3,866,808. Also, compressed air is adapted to be connected by lines 66 to fluid motors for operating the creasing heads I and I' and their clamping blades as well as for effecting inward and outward movement of the creasing heads. It will be noted that the lines 66 are connected between the manifold R and the motors through a timer, valve and pressure gauge assembly 66*a*. Compressed is supplied to the fly pressing motors of the heads J and J' through lines 74.

A cantilever frame M extends forwardly from and is supported by the back end frame D to carry or suspend the upper creasing head I. As shown particularly in FIGS. 1, 2 and 3, the cantilever frame M extends horizontally forwardly from a pair of upward extending transversely spaced-apart frame leg members 40 and a pair of backwardly positioned, upwardly extending transversely spaced-apart frame leg members 41. It is further reinforced in its forwardly extending relation by a pair of diagonally extending tie rods 43 which extend from a cross member 42 that is carried by the pair of frame members 41, see particularly FIG. 2. A pair of diagonal braces 78 also extend between the back-positioned frame leg members 41 and the cantilever frame M.

The upper creasing head I is suspended in an operating relation from the cantilever frame M by a pair of vertically extending fluid motors or cylinders 45 and 45' that are mounted on and secured to the cantilever frame M, and have piston rods 46 and 46' that extend from opposite ends of their housing. Rearwardly positioned pneumatic or air motor 45 is flexibly connected to the head I by a flexible mounting assembly T, as shown particularly in FIG. 4. Also, rear air motor 25 is flexibly connected to its head I by a similar assembly T' (see FIG. 1). In this connection, a bottom cross piece or member 48 is secured in a clamped relation against the lower end of the housing of motor 45 by a nut and collar assembly 47 in such a manner that the lower end portion of the piston rod 46 is free to move in and out therethrough. The cross member 48 is, at its opposite ends, provided with holes through which a pair of downwardly extending bolts or threaded guide rods 49 extend. Each rod 49 has a nut 49*a* secured on its threaded end to retain the cross piece 48 thereon. Also, each guide rod 49 carries a spiral tension spring 50 which normally urges the member 48 away from an upper suspension cross member 44 that is secured, as by weld metal w, to side members of the cantilever support frame M. This spring mounting enables the back end portion of the head I (and I') to flexibly accommodate itself to the shape of the leg of the garment which is being finished. The same type of construction is used for mounting the piston rod 26 of a cylindrical, vertically extending fluid motor 25 for the back end of the lower creasing head I.

The front end portions of both creasing heads I and I' have a pivotally mounted construction from the standpoint of the upper cantilever support frame M and lower support frame U through the agency of the piston rods of the motors 45' and 25'. The mounted construction is particularly shown in FIG. 5 of the drawings. Each support frame M and U has a pair of pillow blocks 52 that extend downwardly from side members of their respective frames and pivotally carry short length pivot pins or rods 51, in such a manner that the front end portions of the heads I and I' are free to pivot from the standpoint of their mounted, supported relation on the support frame M and U. Again referring to FIG. 5, each of the pivot pins or rods 51 is secured, as by weld metal w, on a cross piece or connecting member 48. A nut and collar assembly 47 secures the housing of the fluid motor 45' or 25' to the cross piece 48 in such a manner as to permit free sliding movement of the associated piston rod 46' or 26' therethrough.

As shown in FIG. 1, inner threaded ends of the piston rods 26, 26', 46 and 46' are pivotally secured to the central base members 30 of each of the creasing heads I and I' by bifurcated mounts 37 that may be secured in position on the associated heads by weld metal w.

A secondary or short length telescopic cantilever frame M' (see FIGS. 1, 3 and 6A) is lengthwise adjustable by means of adjustment set screws 76 to carry an upper crotch head operating fluid or pneumatic motor or cylinder 70. Piston rod 71 of this motor 70, like the piston rod 46 of the motor 45, is flexibly connected to an outer or upper fly-pressing head J with the same type of spring mounting 72 shown in FIG. 4 to thus permit flexible conformation of the head J to the crotch of the garment G being finished (see the dash lines of FIG. 3). The head J is shown of solid cylindrical shape and as provided with the electric heating unit 77, since shock hazard is minimal. The support frame M', like the frame M, is secured at its back end to upright frame members 40 and 41. As shown in FIGS. 1 and 3, a slide-guide rod or pin 73 is secured on the plate of spring and plate mounting assembly 72 and slidably extends through a guide hole in the frame M' to provide a stabilized guided inward and outward movement of the outer fly-pressing head J.

As particularly shown in FIG. 6, an inside, opposed crotch or fly-pressing head J' of rectangular shape is mounted on an extension of the back frame D by means of a forwardly extending bracket arm frame 80. The head J' may have a soft fabric cover 84 and has a somewhat flexible mounting to facilitate confirmation to the shape of the particular garment. The mounting includes a backwardly extending connecting rod 81 that is pivotally secured at its upper end thereto; the rod may be endwise slidably mounted to extend through aligned holes in the frame 80. A nut 81*a* mounted on the lower, threaded end of the rod 81 retains it in position with respect to the frame 80. The front portion of the pressing head J' is pivotally secured to a piston rod 83 of a dual-acting pneumatic or fluid-air motor 82 whose cylinder is also secured to the frame 80 as by a threaded collar and nut assembly 79. Thus, crotch or fly-pressing head J' may be pivotally moved against the inside of the crotch of the garment G being finished in a shape-conforming relation with the outer or top pressing head J.

Each fluid motor 45, 45' 25 and 25' for creasing head "in" and "out" movement may be provided with a safety locking mechanism 60 (see A FIGS. 4 and 4A) which is actuated when the two creasing heads I, I' are moved into a proper fabric folding-over relation with cooperating blades 24 of the creasing-blade assembly F. The locking mechanisms 60 are adapted to prevent an over-movement of the heads I and I' that might damage the equipment, as well as the garment being finished. One locking mechanism 60 which may be located at the rear end portion of the lower creasing head I', is operated by a micro valve unit 96 (see FIG. 11) that serves as a master control from the standpoint of the other three locking mechanism. Each locking mechanism 60 is controlled by a miniature or micro valve unit 95, 95', 96 and 96' having a projecting operating finger and is carried by back and front end portions of the upper and lower creasing heads I and I'. The fingers are adapted to engage and to be pressure-operated by an associated creasing blade 24 through the garment material to supply energizing air pressure to a fluid motor or cylinder of each locking unit 60.

Particular attention is called to FIGS. 4 and 4A which show a typical locking mechanism unit 60 which is of the same construction for the front and back end portions of the upper creasing head I and for the front and back end portions of the lower creasing head I'. The housing of each fluid of air motor or cylinder 67 is shown secured to a fixed-position, cross support piece or member 54 by a threaded collar and nut assembly 53. The collar extends from an end of the housing of locking motor 67 through the cross piece 54 to receive the unit and slidably by-pass piston rod 58 therethrough. The cross piece 54 is also shown secured substantially centrally thereof to the end of the housing of fluid motor 45 by an extending threaded collar and nut assembly 62 through which piston rod 46 operatively extends.

A locking swing arm 55 is at one end pivotally mounted on pin 56*a* for swinging movement on a backwardly extending bolt or threaded rod 56. The bolt 56 is secured at its inner end by a nut and washer assembly 56*b* to extend from an end of the lower cross piece or member 54 that is opposite to the end through which the piston rod 58 of the locking motor 67 extends. The upper end of the piston rod 58 of the locking motor 45 is threaded and operatively extends through the locking swing arm 55. A nut 63 secures the forward end of the swing arm 55 to the threaded end of the piton rod 58 for movement therewith. A spiral expansion spring 59 is carried on the piston rod 58 between fixed position cross piece 54 and the swing arm 55 to normally urge the swing arm to an upper, diagonal position on the pivot pin 56*a*, as indicated by the dot and dash lines of FIG. 4.

The piston rod 46 extends through a slightly elongated slot in the swing arm 55. As also shown in FIGS. 4 and 4A, a slightly off-horizontally, vertically bent or offset, split ring or washerlike locking element 57 is carried on the piston rod 46 between the inner side of the swing arm 55 and a ferrule or collar 61 adjacent to the assembly 62. Normally, the lock washer type of locking spring element 57 will fit loosely on the piston rod 46 in a vertically offset relation when no compression force is applied thereto. However, compression or clamping force applied to the washer element 57 between the ferrule 61 and the underside of the swing 55 will cause the element to flex towards horizontal or flat position with respect to the piston rod 46 and lock the rod against further movement. This occurs when, as shown by the full lines of FIG. 4, positive fluid pressure is applied to the fluid locking motor 67 to cause its piston rod 58 to move or draw the swing arm 55 inwardly to compress the spiral spring 59 and compress the locking washer element 57 between the arm 55 and the ferrule 61. When positive fluid pressure is released, as by a shuttle valve 64, the spring 59 will cause the swing arm 55 to move to its outer, diagtonal (dot and dash) position to thus release the locking action of the element 57 and permit operative movement of the piston rod 46 of the creasing head operating fluid motor 45.

Each head operating motor 45, 45', 25 and 25' is provided with the same type of locking unit mechanism 60 that is mounted and operated in the same manner as shown applied to the motor 45 and as controlled by a contact finger of a micro valve 95, 95', 96 or 96' (see the operating diagram of FIG. 11).

Employing the fluid circuit or system shown in FIG. 11, the operation of the machine is such that after the locking cylinders or motors 67 have been actuated to positively prevent any further "in" movement of the creasing heads I and I' with respect to the garment G being finished, there will be a timed dwell period within which a full creasing of the legs of the garment is effected by the heads I and I'. This will occur after the finger of blade retracting micro valve 97 has been actuated by the lower creasing head I' on reaching its innermost garment creasing position to supply air under pressure to actuate fluid motor assembly P for retracting the blades of the creasing blade assembly F and returning them to their initial, at least partially collapsed starting positions of FIG. 1. This occurs in a timed relation after micro valves 95, 95', 96 and 96' have been actuated to operate the locking units 60. When the micro control valves 95, 95', 96 and 96' are opened to exhaust air from cylinders or motors 67 of the locking units 60, they will be returned to their starting positions by the spring 59. This causes the piston rods 26, 26', 46 and 46' to be released from their locking washer elements 57, such that they may then be energized to move the heads I and I' to their backward or outer positions with respect to the garment G.

Compressed air for operating the fluid motors 45, 45' 25 and 25' for the creasing heads I, I' and fluid motors 70 and 82 (see FIG. 11) for the fly-pressing heads J and J' to move them into and out of pressing positions is supplied by flexible lines or hose leading from the regulator unit R (see also FIGS. 1 and 3). Valves provide a reverse flow for the motors when an opposite direction of movement is in order.

Figure 12:
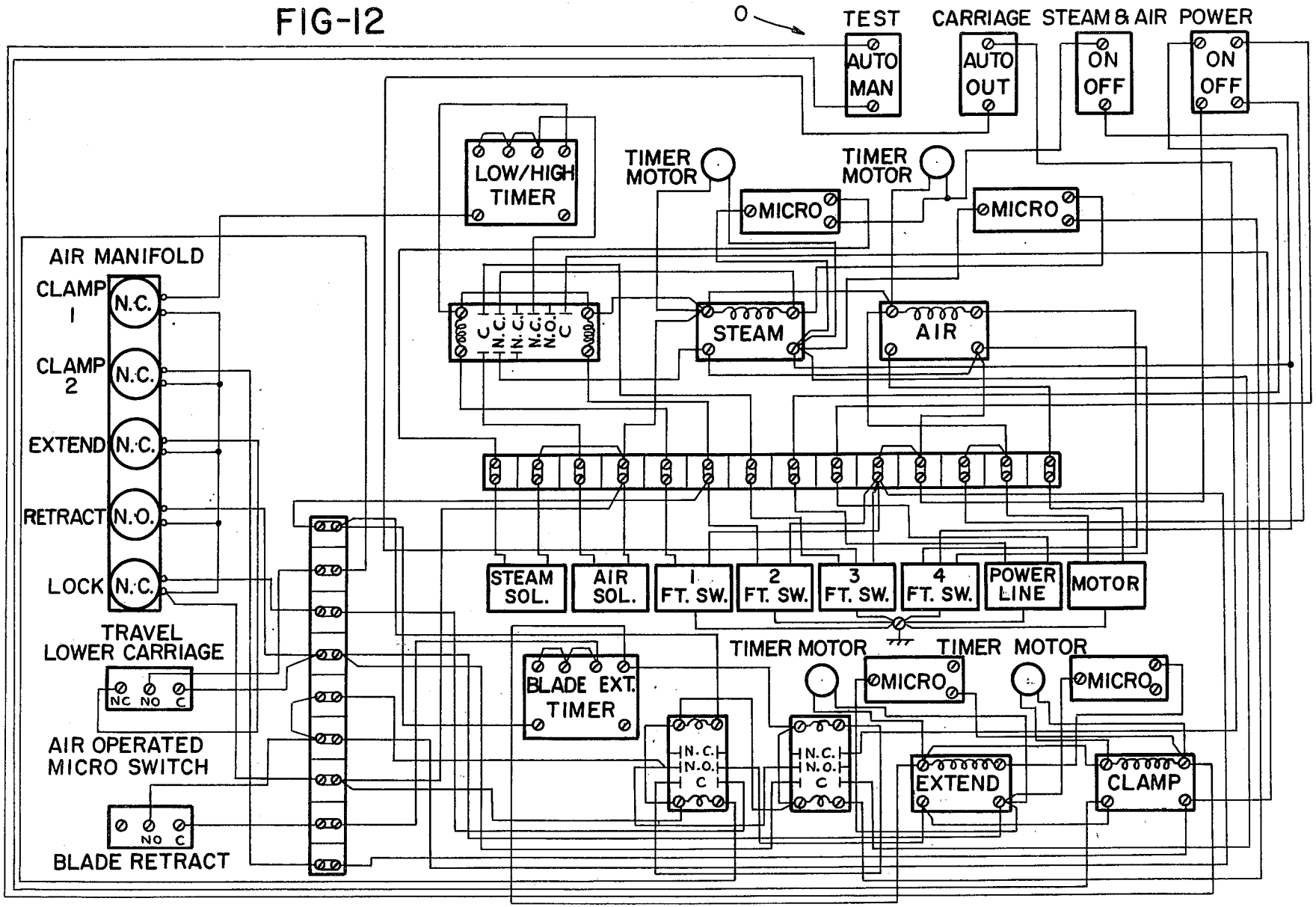
FIG. 12 is an electric circuit diagram illustrating electrical connections and control means for effecting automatic operation of the fluid or air-operated mechanism of FIG. 11.

The control diagrams of FIGS. 11 and 12 are included in this application to show representative systems for automatically controlling the operation of the machine. The machine's operations may be accomplished automatically by the use of timers, control valves, switches and electric solenoid operated valves, etc., or by manually controllable switches and valves. In FIG. 11, reference numerals corresponding to apparatus shown in FIGS. 1 to 10, inclusive, have been added and short descriptive terminology has been employed for other equipment that is only represented in the diagram. In this FIG. 11, the bottom clamping blade operating fluid motors 35' may be only fluid-operated to close the blades 29 and apply positive fluid pressure thereto; in such event, each contains a spiral spring in its cylinder to swing the blades to an "open" position when positive fluid pressure is released.

In the electric system of FIG. 12, descriptive indicators are used wherein N.C. represents normally closed switches, while N.O. represents normally open switches. One foot pedal of the group O (see also FIG. 3) is a control for moving the system from an automatic to a manual operation and vice versa. A second is for moving the creasing blade assembly F to an expanded relation on manual operation. The third is for moving stream and air into the fabric bag, and the fourth is an electric power "off" and "on" switch. With reference to control board N shown in FIG. 3, a is a power switch, b is a switch controlling the air and steam combination, c is a switch for carriage control, d is a clamp testing switch, e controls air pressure, f controls steam supplied, g is a push button switch for applying low to high crease pressing pressure to the motors 35 and 35', h is a control for a timer of carriage closing time, i is a control for a timer of carriage extension time, and j is a push button switch for blade extraction time control.

I claim:

1. In a finishing machine for a pants-like garment having a support base, a longitudinal-horizontally extending permeable bag carried by said support base for receiving and positioning a garment therealong, means for applying hot steam and air through said bag to the inside of the garment to expand it, means carried by said support base for internally engaging and then folding-over material of the expanded garment to form preliminary creases therealong, means for thereafter applying heat and externally applying pressing force to the preliminary creases for forming final creases along the material of the garment, and said means for folding-over material of the expanded garment having means for moving it out of engagement with the material before pressing force is externally applied to the preliminary creases by said second-mentioned means.

2. In a garment finishing machine having a support base, longitudinally-extending garment-supporting arm means carried by the support base and adapted to position a garment therealong, and means for supplying heated finishing fluid along the garment in its supported relation on the arm means, the improvement which comprises, a pair of creasing heads, carrying means for positioning each of said heads along the arm means, means for moving each of said creasing heads into and out of a cooperating relation with respect to the outside of the garment as supported by the arm means, means carried by each of said creasing heads for folding-over length portions of the garment and for thereafter forming final creases along the folded-over length portions, and each of said creasing heads having means for, during its movement towards the garment, adjusting its cooperative positioning along and with respect to the contour of the garment.

3. A garment finishing machine as defined in claim 2 wherein said means for adjusting the cooperative positioning of said creasing heads has means flexibly pivotally connected between each of said creasing heads and said carrying means therefor.

4. In a garment finishing machine for a garment having a support base, longitudinally-extending garment-supporting arm means carried by the support base and adapted to position the garment in a longitudinally extending position therealong, and means for supplying heated finishing fluid along the garment in its supported relation along the arm means, the improvement which comprises, a pair of creasing heads, carrying means for positioning each of said heads in a cooperating relation along the arm means, means carried by the support base for internally engaging and folding-over length portions of the garment to form preliminary creases therealong, means for moving said folding-over means out of engagement with the folded-over length portions of the garment, means for moving each of said creasing heads into a cooperating position with respect to the outside of the garment being supported by the arm means, means carried by each of said creasing heads to, after said folding-over means has been moved out of engagement with the folded-over length portions of the garment, engage the outside of the folded-over length portions and form final creases therealong, fluid motor means operatively connected between each of said pair of creasing heads and its said carrying means for moving each of said heads into and out of a cooperating position with the garment being finished, each of said creasing heads having a central member, and said means carried by each of said heads comprising: a pair of clamping blades hinged on and operatively extending along said central member, and motor means connected to said pair of clamping blades for moving them into and out of a crease-forming pressing position with and along said central member when each of said creasing heads has been moved to a cooperating position with respect to the garment being finished.

5. In a garment finishing machine for a garment having a support base, longitudinally-extending garment-supporting arm means carried by the support base and adapted to position the garment in a longitudinally extending position therealong, and means for supplying heated finishing fluid along the garment in its supported relation along the arm means, the improvement which comprises, a pair of creasing heads, carrying means for positioning each of said heads in a cooperating relation along the arm means, means carried by the support base for internally engaging and folding-over length portions of the garment to form preliminary creases therealong, means for moving said folding-over means out of engagement with the folded-over length portions of the garment, means for moving each of said creasing heads into a cooperating position with respect to the outside to the garment being supported by the arm means, means carried by each of said creasing heads to, after said folding-over means has been moved out of engagement with the folded-over length portions of the garment, engage the outside of the folded-over length portions and form final creases therealong, said supporting means having creasing blades adapted to move into engagement with the inside of the garment and in an opposed operating relation with respect to said creasing heads, means adapted to move said creasing heads into preliminary folding-over creasing positions along the garment and with respect to said creasing blades, means adapted to thereafter move said creasing blades out of engagement with folded-over portions of the garment, means carried by said creasing heads adapted to then apply a final crease-forming pressure along the folded-over portions of the garment, said means carried by said creasing heads being fluid motor means adapted to preliminarily apply a lesser folding-over force to each of said heads and to thereafter apply a final greater crease-forming force thereon when said creasing blades are moved out of engagement with the folded-over portions of the garment.

6. In a garment finishing machine for a pants-like garment having a support base, arm means carried by the support base for receiving and positioning the garment therealong, and means for supplying heated finishing fluid along the garment in its supported relation on the arm means, the improvement which comprises, a pair of creasing heads, carrying means for positioning each of said heads along the arm means, fluid motor means for moving each of said creasing heads into and out of a cooperating inward position with respect to the outside of the garment as supported by the arm means, means carried by each of said creasing heads for folding-over length portions of the garment and for forming final creases along the folded-over length portions, and locking means timed to the inward movement of said creasing heads for positively mechanically limiting and locking them in their maximum inward positioning with respect to the garment and for thereafter releasing said heads after the final creases have been formed.

7. A garment finishing machine as defined in claim 6 wherein said locking means comprises a second fluid motor having a mechanical inter-connection with said first-mentioned fluid motor means.

8. In a garment finishing machine having a support base, longitudinally-extending garment-supporting arm means carried by the support base and adapted to position a garment therealong, and means for supplying heated finishing fluid along the garment in its supported relation on the arm means, the improvement which comprises, a pair of creasing-heads, carrying means for positioning each of said heads along the arm means, means for moving each of said creasing heads into and out of a cooperating position with respect to the outside of the garment as supported by the arm means, means carried by each of said creasing heads for folding-over length portions of the garment and for thereafter forming final creases along the folded-over length portions, a pair of separate inner and outer fly-pressing heads operatively carried for cooperative movement into and out of a crotch-pressing position between the outside and inside of the garment, means carried by at least one of said fly pressing heads for heating it.

9. A garment finishing machine as defined in claim 8 wherein, each of said fly-pressing heads is mounted on independently operated arm means, and fluid motor means cooperates with each of said arm means for moving said fly-pressing heads into and out of opposed pressing relation with respect to each other along the fly of the garment during the forming of creases along the garment by said creasing blades.

10. A garment finishing machine as defined in claim 8 wherein said fly-pressing heads have means for, during their movement towards a fly pressing position with respect to the garment, adjusting their cooperating positioning along and with respect to a contour of the garment.

11. In a garment finishing machine having a support base, longitudinally-extending garment-supporting arm means carried by the support base and adapted to position a garment therealong, and means for supplying heated finishing fluid along the garment in its supported relation on the arm means, the improvement which comprises, a pair of creasing heads, carrying means for positioning each of said heads along the arm means, means for moving each of said creasing heads into and out of a cooperating position with respect to the outside of the garment as supported by the arm means, means carried by each of said creasing heads for folding-over length portions of the garment and for threafter forming final creases along the folded-over length portions, said means carried by each of said heads including a pair of creasing blades, means hingedly mounting each said pair of blades along opposite sides of their associated said head for swinging movement into and out of a cooperating garment-folding crease-forming relation therewith, and fluid motor means connected at its opposite ends between each said pair of blades for cooperatively swinging them into and out of a close crease-forming position with respect to the opposite sides of their associated heads.

* * * * *